US005080579A

United States Patent [19]

Specht

[11] Patent Number: 5,080,579

[45] Date of Patent: Jan. 14, 1992

[54] APPARATUS FOR PREHEATING WASTE OIL

[75] Inventor: Werner O. Specht, Sharpsville, Pa.

[73] Assignee: FL Industries, Inc., Livingston, N.J.

[21] Appl. No.: 477,250

[22] Filed: Feb. 7, 1990

[51] Int. Cl.[5] ..... F23D 11/44

[52] U.S. Cl. ..... 431/207; 431/11; 431/36; 431/37; 431/41; 431/208; 239/128

[58] Field of Search ..... 431/208, 207, 36, 37, 431/41, 28, 11, 38, 39; 239/128, 132, 135

[56] References Cited

U.S. PATENT DOCUMENTS 2,199,454 5/1940 Andler et al. ..... 239/135 X
2,876,830 3/1959 Duy .
4,797,089 1/1989 Schubach et al. .

FOREIGN PATENT DOCUMENTS 2302482 9/1976 France .
2626353 7/1989 France ..... 431/11
445724 4/1936 United Kingdom ..... 431/208

OTHER PUBLICATIONS

English language translation, France Pat. No. 2302482, 9/1976, Poirier.

*Primary Examiner*—Carl D. Price
*Attorney, Agent, or Firm*—John D. Kaufmann

[57] ABSTRACT

A preheater system for waste oil burners utilizes a primary preheater remote from the burner nozzle and a secondary preheater adjacent the burner nozzle. The primary preheater ordinarily provides heat to the waste oil when the burner is operating. The secondary preheater ordinarily maintains the waste oil adjacent the burner nozzle at atomization temperature when the burner is not operating. Flow of waste oil from the primary preheater to the burner nozzle is precluded when the burner is not operating.

5 Claims, 1 Drawing Sheet

APPARATUS FOR PREHEATING WASTE OIL

BACKGROUND OF THE INVENTION

This invention relates to oil burners. In particular this invention relates to a method of and apparatus for preheating oil for combustion, e.g. preheating waste oil for combustion in a waste oil burner. The inventive method and apparatus are uniquely effective in precluding nozzle drip.

The onset of increased environmental awareness heralded concerns for developing new and improved methods for disposing of waste products. High on the list of waste products to be soundly disposed of has been waste oil. The term waste oil has been used to define heavy oil as well as spent or used oil. Heavy oils include API designations Nos. 5 and 6. These oils are difficult to combust in view of their complex hydrocarbon structure and the fact that they ordinarily contain impurities at inconsistent levels. Waste oils such as used cutting oil, used automotive oils and the like, exhibit many of the combustion characteristics of heavy oils. Further, their characteristics are changed by additives, foreign particles, and the fact that through use their viscosity tends to increase.

All these factors have resulted in difficulties being experienced in designing methods and apparatus for the efficient combustion of waste oil. The coking temperature of waste oils is ordinarily much lower than that of corresponding clean oils. Complicating this is the fact that use and the existence of additives and other impurities increase the viscosity of the waste oils thereby requiring a relatively high degree of preheat to achieve proper atomization for combustion.

Approaches which have been advanced in attempting to deal with these and other such problems are shown in U.S. Pat. Nos. 4,249,885, 4,406,943 and 4,797,089. However, these methods, for example those such as that disclosed in U.S. Pat. No. 4,797,089, have experienced difficulties, particularly in applications involving start-stop operations such as those required in the operation of space heaters or unit heaters.

It is well known to those skilled in these arts that in waste oil heater applications involving start-stop or on-off operations, nozzle drip has been a continuing problem. In order to achieve the temperature needed to properly atomize the waste oil, preheaters have been positioned substantially adjacent the burner nozzles and sized such as to be able to transfer sufficient heat to increase the temperature of the flowing oil to atomization temperature. This is fine so long as the system is operating and the oil flowing. However, when the thermostat controlling the space heater calls for the space heater to turn off, the flow of oil stops. Known preheaters are not capable of instantaneous termination of heat transfer to the waste oil. More specifically, known preheaters act as "heat sinks" and transfer heat to waste oil in the preheater even after flow terminates. The continued transfer of heat to the waste oil causes the temperature of the waste oil to increase above that which would otherwise be satisfactory to atomize the waste oil for combustion.

In extreme situations such temperature increases can cause coking of the waste oil with resultant clogging of the waste oil supply line. What occurs more usually, however, is that the oil will expand. Because back flow of the oil in response to such expansion ordinarily is precluded by a positive block in the oil line established either by a valve or a positive-displacement waste oil pump, the hot expanded waste oil follows the path of least resistance and flows out of the burner nozzle into the combustion chamber. This is "nozzle drip". The adverse effects of such "nozzle drip" are well known.

SUMMARY OF THE INVENTION

It is an object of the present invention, therefore, to provide a preheater system for a waste oil burner which minimizes or precludes nozzle drip.

A still further object of the present invention is to provide a preheater system for an on-off waste oil burner wherein continued heating of waste oil by the preheater system is precluded from causing nozzle drip.

These objects and others not enumerated are achieved by the preheater system of the present invention, one embodiment of which may include a primary preheater disposed upstream of a flow interrupting means remote from the burner nozzle, and a secondary preheater disposed substantially adjacent the burner nozzle.

A method of preheating waste oil according to the present invention may include the steps of preheating the waste oil to a temperature level satisfactory to atomize the waste oil for combustion during operation of the burner, and maintaining the waste oil adjacent the burner nozzle at a temperature level satisfactory to atomize the waste oil for combustion when the burner is not in operation.

BRIEF DESCRIPTION OF THE DRAWINGS

A more complete understanding of the present invention may be had from the following detailed description, particularly when considered in light of the accompanying drawings, wherein.

DETAILED DESCRIPTION

As noted above, this invention relates to waste oil burners. In particular, this invention relates to a preheater system for waste oil burners which minimizes or precludes nozzle drip.

Waste oil burners are often utilized in "on-off" applications. For purposes of this disclosure, "on-off" burner applications are those in which the burner may be in an on-operation condition, i.e. the burner is being used for combustion of waste oil, and alternatively the burner may be in an off-operation condition, i.e. the burner is not being used for combustion but rather is on a "stand-by" mode. The efficient operation of such "on-off" waste oil burners contemplates that in response to a call for heat from a control means such as a room thermostat, the burner will substantially immediately go into "on-operation" mode and in response to an indication of no heat required from the control means the burner will substantially immediately go into "off-operation" mode. Thus, uninterrupted operation of a burner system according to the present invention contemplates that when the control means calls for heating, the waste oil adjacent the burner nozzle be at a temperature which will permit proper atomization to support combustion without further preheating. The present invention provides a preheating system which accomplishes these ends.

Figure 1:
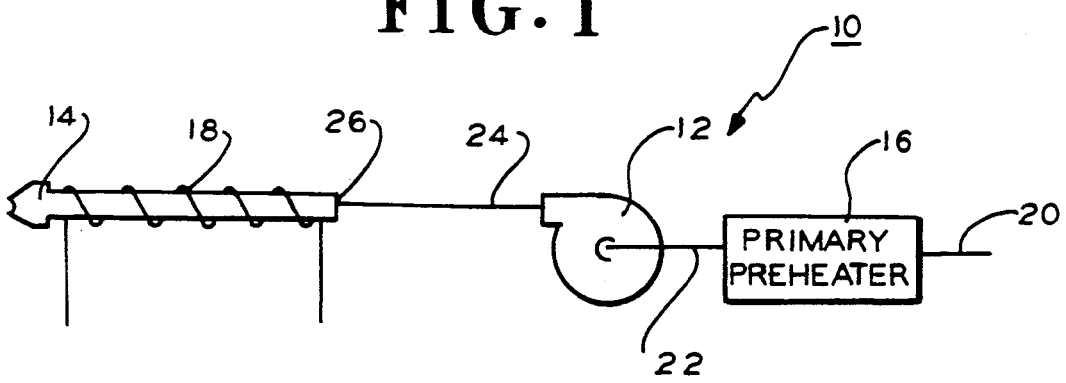
FIG. 1 is a schematic view of a waste oil preheater system according to the invention.

Referring now to FIG. 1, there is shown a waste oil burner preheater system according to the present invention. The inventive system, designated generally by the reference numeral 10, includes a waste oil pump 12, a burner nozzle 14, a primary preheater 16 and a secondary preheater 18. The particular units comprising the components of the inventive combination may be custom or selected from commercially available elements. Their specific structures are well within the knowledge of those with ordinary skills in these arts.

In operation of the system 10, waste oil is supplied to primary preheater 16 from a storage area (not shown) through a supply line 20. Primary heater 16 may include a heating element mounted in a heat sink such as an appropriate aluminum block with suitably mounted temperature sensors. Heater 16 operates to heat flowing waste oil to a temperature, e.g. 175° F., which is sufficient to provide waste oil at approximately 135° F. at the burner nozzle, a suitable temperature to atomize the waste oil for combustion. Thus, heater 16 heats the waste oil to proper combustion temperatures when the burner is in the on-operation mode.

Waste oil discharging from primary preheater 16 passes through oil transfer line 22 to waste oil pump 12. In the embodiment of invention shown in FIG. 1, pump 12 discharges oil through oil transfer line 24. The oil then enters burner nozzle 14 at inlet end 26. As waste oil passes through burner nozzle 14, it may be heated by secondary preheater 18 to the extent that the waste oil temperature is below atomization temperature, e.g. 135° F., which is necessary to provide atomization for proper combustion. However, the addition of heat by the secondary preheater during on-operation of the system ordinarily is not necessary.

In this regard, typical operation of the preheater system according to the present invention includes the steps of start-up, on-operation, stand-by (off-operation), on-operation and shut-down.

Considering initially the start-up, let us assume that a burner system with a preheater system according to the present invention has been shut-down for a sufficient period of time such that all of the system components and the waste oil contained therein have reached an ambient temperature of 60° F. Upon receiving a signal to commence operation, primary preheater 16 and secondary preheater 18 are energized to commence preheating the oil contained therein to the predesignated temperatures. In the case of primary preheater 16, typical outlet oil temperature might be 175° F. In the case of secondary preheater 18, a typical outlet (atomization) temperature might be 135° F.

Upon reaching an appropriate temperature in the preheaters, e.g. 155° in the primary heater and 120° F. in the secondary preheater, low temperature limit switches associated with each preheater act to permit pump 12 to be activated in response to a call for heating by the space temperature sensor, e.g. a room thermostat.

When the room thermostat (not shown) calls for heating, the secondary and primary preheaters are energized and the pump activated. Any oil between the primary preheater and the secondary preheater which is at a temperature below atomization temperature is heated appropriately by the secondary preheater. In non-start-up operation, however, the primary preheater discharges waste oil at a temperature level which, after passage from the primary preheater to the burner nozzle, is at a proper atomization temperature without additional heat input from the secondary preheater.

The cooperation of the primary and secondary preheaters precludes nozzle drip. More specifically, during ordinary operation the primary preheater discharges oil at a temperature which results in delivery of the oil to the burner nozzle at an appropriate atomization temperature, e.g. 135° F. The secondary preheater, as noted above, is calibrated to heat oil within the barrel to 135° F. Therefore, when the thermostat calls for no heat, the pump stops and the primary preheater is de-energized. Because the secondary preheater is not energized during normal on-operation, there is no build-up of heat in the secondary preheater which will increase the temperature of the oil therein above the atomization temperature. As a result, there is no expansion and no nozzle drip. Any tendency of oil in the primary preheater to expand is isolated from the burner nozzle by the pump which, being a positive displacement pump, precludes flow of oil between the primary and secondary preheaters when not in operation.

In the event that pump 12 is not a positive displacement or other type pump such as to constitute a flow barrier when not operating, a valve means may be provided to fluid-isolate waste oil in primary preheater 16 from that in burner nozzle 14 when the burner is in off-operation. In either event, an increase in temperature of oil in the primary preheater 16 does not cause oil expansion which results in nozzle drip.

Figure 2:
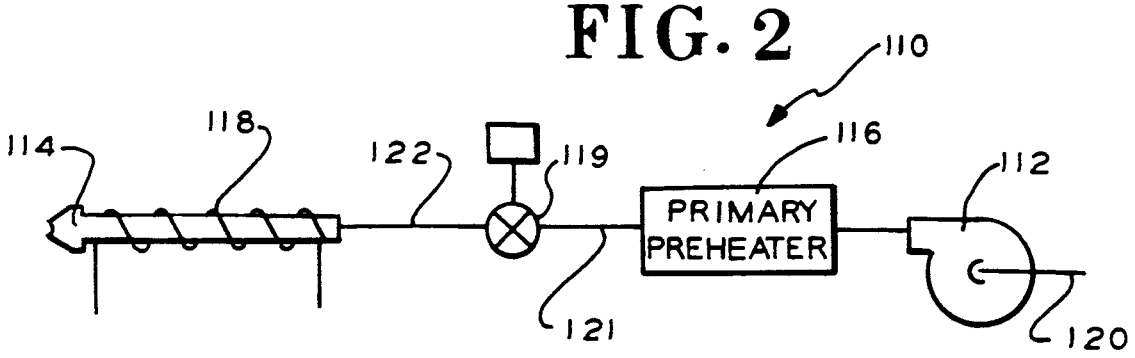
FIG. 2 is a schematic view of a second embodiment of waste oil preheater system according to the present invention.

Those skilled in these arts will recognize that the waste oil pump may be located upstream of the primary preheater. Referring therefore to FIG. 2, there is shown a waste oil burner preheater system according to the present invention designated generally by the reference numeral 110. The burner system includes a waste oil pump 112, a burner nozzle 114, a primary preheater 116, a secondary preheater 118 and a motor operated valve 119.

In operation of the system 110, waste oil is supplied to waste oil pump 112 from a storage area (not shown) through a supply line 120. Pump 112 thereafter pumps the waste oil through primary heater 116 and to burner nozzle 114 through oil line 121, valve 119 and oil line 122 into the inlet end of burner nozzle 114.

In ordinary operation, all preheating during the on-operation phase is accomplished by primary preheater 116. The primary function of secondary preheater 118 is to maintain the temperature of waste oil at a level which is appropriate to support atomization for combustion during off-operation of the burner systems. This, of course, is similar to the operation of system 10 discussed above.

In this regard, the difference between system 10 and system 110 is that oil pump 112 is upstream of preheater 116 rather than being downstream thereof as is shown in regard to system 10. Accordingly, in order to achieve fluid isolation of primary preheater 116 from burner nozzle 114, valve 119 is provided.

When the system 110 is in the on-operation mode, valve 119 is open. When system 110 is in the off-operation mode, valve 119 is closed. As a result, when the system is in off-operation mode, the heat sink effect of primary preheater 116 is isolated from the nozzle-adjacent area by the interruption of valve 119.

With respect to both embodiments of systems, therefore, the primary preheater is isolated from the burner nozzle during off-operation of the system. As such, increased temperature of the waste oil and the resulting tendency to expand are isolated from the burner nozzle as a result of which nozzle drip is minimized or precluded.

It can be seen, therefore, that by providing primary and secondary preheating means according to the present invention a waste oil burner system can be maintained ready for use at all times and yet, not be subject to nozzle drip.

It will be recognized by those skilled in these arts that various modifications and variations can be made to the invention without departing from the spirit and scope thereof.

What I claim is:

1. An improved preheating arrangement for a selectively operable waste oil burner, the burner being of the type which includes a nozzle for receiving waste oil heated to a first selected combustion-enhancing atomization temperature, the oil being delivered to the nozzle from a source thereof by a selectively operable pump remote from the nozzle, wherein the improvement comprises:

(a) a primary preheater remote from the nozzle, the primary preheater heating the oil to a second selected temperature higher than the first selected temperature, the oil experiencing heat loss between the primary preheater and the nozzle to an extent such that, if the pump has been operating for a predetermined time, the temperature of the oil reaching the nozzle is, after experiencing the heat loss, at the first selected temperature;

(b) a secondary preheater proximate the nozzle, the secondary preheater maintaining at the first selected temperature oil which is located thereat at the time of, and immediately following, initiation of operation of the pump after a period of nonoperation thereof, the secondary preheater being normally inoperative if the pump has been operating for the predetermined time; and (c) means between the preheaters for preventing oil which is heated by the primary preheater, and which expands as a consequence thereof, from flowing to the nozzle as and after the pump ceases operation.

2. An arrangement as in claim 1, wherein:

the primary preheater is inoperative when the pump is inoperative, and the secondary preheater is operative (i) when the pump is inoperative and (ii) for so long as oil thereat is below the first selected temperature when the pump is operative.

3. An arrangement as in claim 1, wherein; the preventing means is a valve.

4. An arrangement as in claim 1, wherein:

the pump is a positive displacement pump which also constitutes the preventing means.

5. An arrangement as in claim 1, wherein:

the primary preheater is operative when the pump is operative and is inoperative when the pump is inoperative, oil in the vicinity of the primary preheater when the pump and the primary preheater cease operation following the predetermined time being and continuing to be, heated by the primary preheater due to its thermal inertia to a temperature whereat significant expansion thereof occurs, and the secondary preheater has been inoperative prior to, and remains inoperative at, the time when the pump and the primary preheater cease operation, so that oil at the secondary preheater is not heated thereby and does not experience significant expansion, whereby the oil experiencing expansion due to primary preheatereffected heating is not permitted to cause dripping of oil from the nozzle due to the action of the preventing means.

* * * * *